US006799396B1

(12) United States Patent
Redfern et al.

(10) Patent No.: US 6,799,396 B1
(45) Date of Patent: Oct. 5, 2004

(54) WATERTIGHT DOOR CLOSURE

(75) Inventors: Robert C. Redfern, Glassboro, NJ (US); Ted A. Heinritz, King of Prussia, PA (US); Constantine V. Pappas, Philadelphia, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/322,725

(22) Filed: Dec. 19, 2002

(51) Int. Cl.[7] ..... E05C 9/00
(52) U.S. Cl. ..... 49/395; 292/48
(58) Field of Search ..... 49/394, 395; 292/46, 292/47, 48, 49, 12, 197, DIG. 12

(56) References Cited

U.S. PATENT DOCUMENTS 2,205,845 A * 6/1940 Cochran ..... 114/117
2,493,882 A * 1/1950 Lambert ..... 292/48
2,610,079 A * 9/1952 Lambert ..... 292/196
2,784,443 A 3/1957 Von Berg
5,492,350 A 2/1996 Pan
5,524,506 A 6/1996 Terry
6,123,370 A * 9/2000 Rozema et al. ..... 292/47
6,363,577 B1 4/2002 Spitzley

* cited by examiner

*Primary Examiner*—Jerry Redman
(74) *Attorney, Agent, or Firm*—Jacob Shuster

(57) ABSTRACT

A hinged door panel selectively closing an opening within an enclosure wall is held under adjusted watertight pressure by means of a plurality of elongated closure holding devices pivotally mounted on the enclosure by a frame in surrounding relation to the opening. The closure holding devices are selectively displaced from release positions to closure holding positions overlapping sealing contact surfaces formed by wedge elements on the door panel. Wear pads project from the overlapping closure holding devices to engage the contact sealing surfaces on the wedge elements under the adjusted pressure, to effectively seal the enclosure opening in a watertight manner.

5 Claims, 2 Drawing Sheets

WATERTIGHT DOOR CLOSURE

BACKGROUND OF THE INVENTION

The present invention relates to closure of openings in enclosures subject to underwater exposure during travel, such as those on board Naval sea vessels.

SUMMARY OF THE INVENTION

A sea vessel enclosure has its opening closed in a watertight manner by a door panel hingedly mounted on the enclosure wall adjacent to the opening to form an opening closure door pivotally displaced to a closure position. Heretofore, such opening closures arrangements underwent excessive wear requiring frequent and costly repair and replacement of parts to perform closure operation. In accordance with the present invention, a plurality of closure holding devices are pivotally mounted on the enclosure wall by a frame in surrounding relation to the opening. Each of such closure holding devices has a wear pad through which watertight sealage of the opening is effected through a door panel, when the closure holding device is pivotally displaced to its closure position overlapping the door panel and selectively tightened in such closure position for pressurized contact of the wear pad with a sealing surface wedge element welded to the door panel. The wear pad projects from its closure holding device in spaced relation to a spindle projecting from the closure holding device into the enclosure wall through the frame on which the closure holding device is thereby pivotally supported under a spring bias.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

Figure 1:
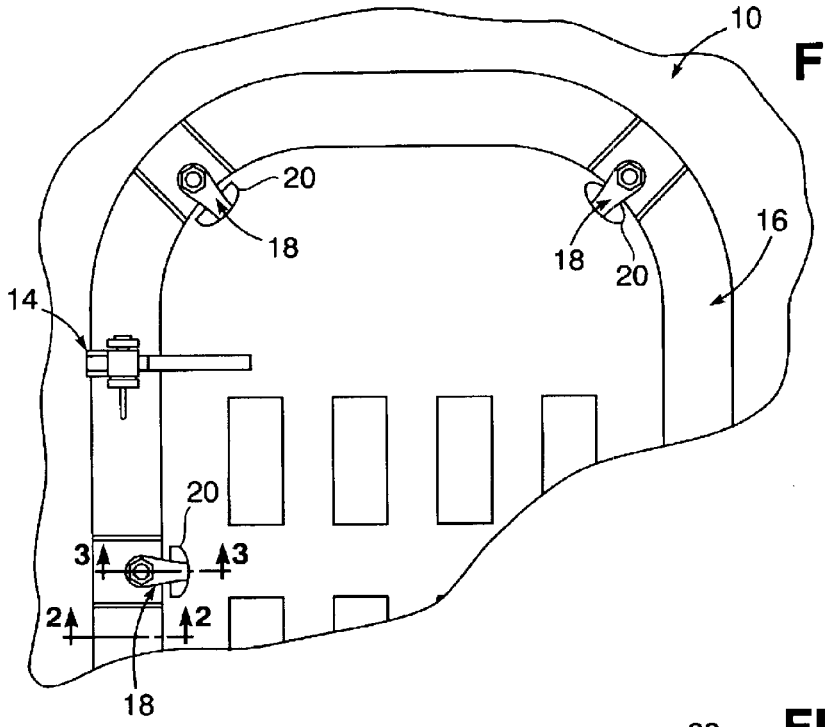
FIG. 1 is a front plan view of an enclosure wall portion having a door panel held in a closure position thereon by a plurality of door closure holding devices.
Figure 3:
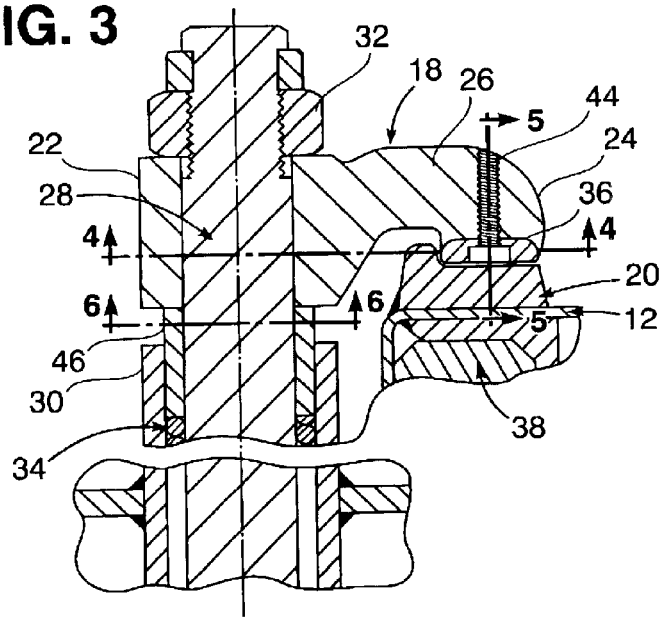
Figure 5:
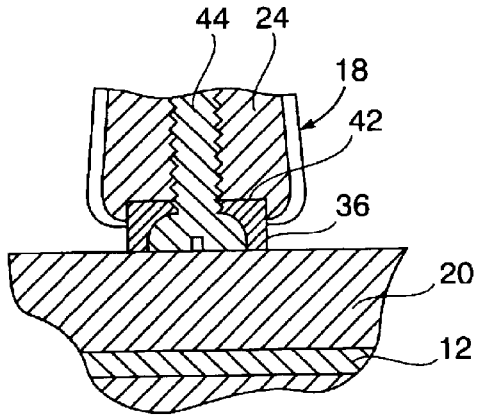
Figure 4:
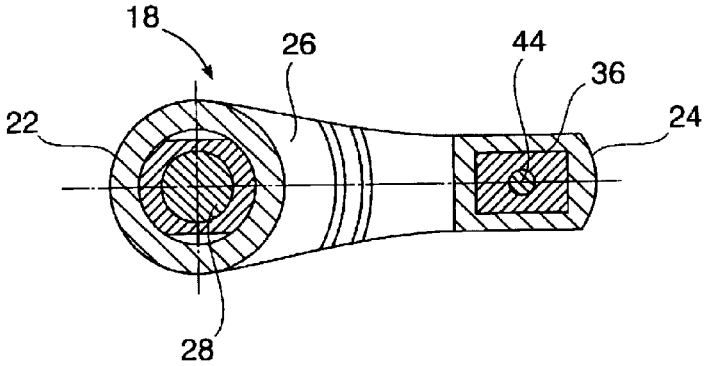
Figure 6:
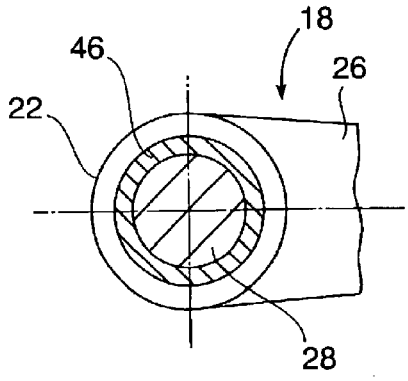

FIG. 3 is an enlarged section view taken substantially through a plane indicated by section line 3-3 in FIG. 1; and FIGS. 4, 5, 6 are section views respectively taken substantially through planes indicated by section lines 4-4, 5-5 and 6-6 in FIG. 3.

DETAILED DESCRIPTION OF PREFERRED EMBODIMENT

Referring now to the drawing in detail, FIG. 1n illustrates a portion of an enclosure wall 10 on which a door panel 12 is pivotally mounted by a plurality of spaced hinges 14 on one vertical side thereof. The door panel 12 covers an opening formed in the enclosure wall 10 as hereinafter referred to. Such opening is surrounded by a frame 16 fixed to the enclosure wall 10, and on which the hinges 14 are mounted for extension onto the door panel 12 to which they are connected. The door panel 12 is thereby pivotally supported in a manner well known in the art for pivotal displacement to and from its opening closure position as shown in FIG. 1.

Figure 1A:
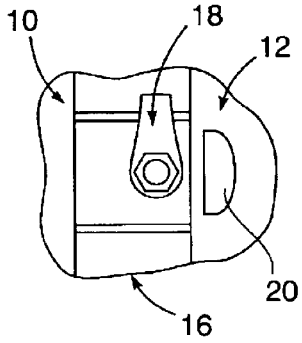
FIG. 1A is a partial plan view corresponding to a portion of FIG. 1, with one of the door holding devices shown in its closure release position.

Pursuant to the present invention, also mounted on the enclosure wall 10 by the frame 16 are a plurality of closure holding devices 18, equally spaced from each other throughout along the frame 16 as shown in FIG. 1, with the hinges 14 on one side of the door panel 12 located between the adjacently spaced closure holding devices 18. As also shown in FIG. 1, each of the closure holding devices 18 is positioned so as to extend from the frame 16 in overlapping relation to the door panel 12 for engagement with a wedge element 20 fixed by welding to the door panel 12, through which sealing contact is established for watertight sealage purposes when the closure holding devices 18 are in the door panel overlapping positions as shown in FIG. 1. The closure holding devices 18 are pivotally displaced to release positions confined to the frame 16, retracted from the door panel 12, as shown in FIG. 1A. In such release positions of the closure holding devices 18, the door panel 12 may be pivotally displaced under selective control from its closure position as shown in FIG. 1 so as to unseal and expose the opening in the enclosure wall 10.

Figure 2:
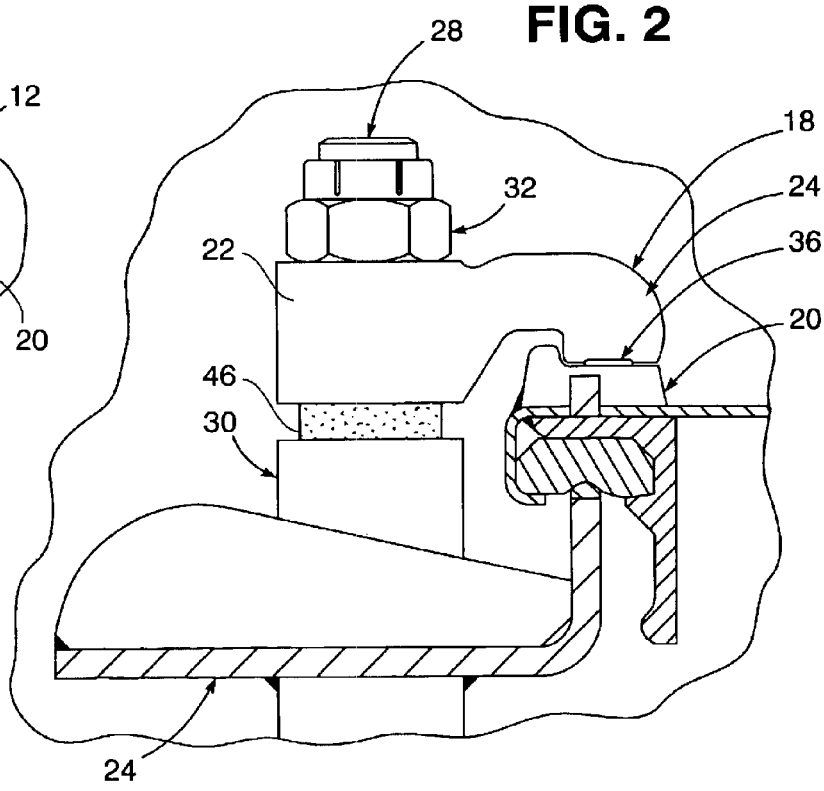
FIG. 2 is an enlarged section view taken substantially through a plane indicated by section line 2-2 in FIG. 1.

Referring now to FIGS. 2, 3, 4 and 6, each of the closure holding devices 18 is formed from a rigid elongated metallic element having a larger end portion 22 tapering along an intermediate portion 26 thereof to a smaller end portion 24. The closure holding device 18 is pivotally mounted on the enclosure wall 10 through the frame 16 by a spindle 28 extending from the larger end portion 22 of the device 18 into a sleeve 30 fixed to the frame 16. The closure holding device 18 is retained in an adjusted position by an adjusting nut 32. Rotation of the device 18 from its closure positions as shown in FIG. 1 to the portions as shown in FIG. 1A, results in its end portion 22 applying an adjusted sealing contact pressure through a wear pad 36 on the smaller end portion 24 onto the wedge element 20, welded to the door panel 12 as shown in FIGS. 2 and 3. Accordingly, the sealing contact pressure exerted through the wear pad 36 onto the wedge element 20 is transferred through a watertight sealing gasket 38 fixed to the door panel 12, in engagement with a sealing end portion 40 of the enclosure wall frame 16 underlying the door panel 12 as shown in FIG. 2.

As shown in FIG. 5, the wear pad 36 is held in a recess 42 within the end portion 24 of the device 18 by means of a screw 44, and projects therefrom into frictional contact with the wedge element 20 on the door panel 12 under the adjusted pressure as hereinbefore referred to. The wear pad 36 is made of a fire-resistant and moldable material embodying composite fibers, softer than the metallic material of the enclosure wall 10 and the door panel 12.

As shown in FIGS. 1, 3 and 6, a cylindrical bushing 46 is disposed on the spindle 28 underlying and in axial abutment with the end portion 22 of the closure holding device 18. The bushing 46 extends into the sleeve 30 about the spindle 28 and is axially biased upwardly by a spring 34 within the sleeve 30 as shown in FIG. 3. Accordingly, the closure holding device 18 it will be pushed sufficiently away from the edge surface of the panel 12 by the bushing 46 under the bias of the spring 34 so as to avoid impact being applied to the panel during closure operational cycles while the devices 18 are being pivotally displaced to their closure positions shown in FIG. 1.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an enclosure wall having an opening therein adapted to be closed by a door panel hinged to the enclosure wall and pivotally displaced thereon to a position closing said opening, the improvement residing in: means for holding the door panel in said closing position closing the opening with watertight scalage, comprising: a plurality of closure holding devices mounted on the enclosure wall in spaced relation to each other; spindle means mounting each of said closure holding devices for pivotal displacement between a release position spaced throughout from the door panel and said closing position overlapping the door panel; and wear pad means non rotatably fixed to and projecting from each of the closure holding devices for frictional contact holding of the door panel in the closing position for establishing said watertight sealage.

2. The combination as defined in claim 1, including bushing means on the spindle means for biasing the wear pad means fixed to the closure holding devices out of holding contact with the door panel to avoid damaging impact therewith during closure of the opening.

3. The combination as defined in claim 1, wherein each of said closure holding devices is formed from an elongated clement having opposite and portions within which the spindle means and the wear pad means are respectively mounted in spaced relation to each other; and wedge means on the door panel for engagement by the wear pad means to establish said frictional contact holding thereof for the watertight sealage.

4. The combination as defined in claim 1, wherein each of said closure holding devices has opposite end portions within which the spindle means and the wear pad means are respectively mounted; and wedge means fixed to the door panel for engagement by the wear pad means under adjusted pressure establishing said watertight sealage.

5. In combination with an enclosure wall having an opening therein adapted to be closed by a door panel hinged to the enclosure wall and pivotally displaced thereon to a position closing said opening, the improvement residing in: means for holding the door panel in said closing position closing the opening with watertight sealage, comprising: a plurality of closure holding devices mounted on the enclosure wall in spaced relation to each other; spindle means mounting each of said closure holding devices for pivotal displacement between a release position spaced throughout from the door panel and said closing position overlapping the door panel; wear pad means non rotatably fixed to and projecting from the closure holding devices for frictional contact holding of the door panel in the closing position; and wedge means fixed to the door panel for engagement by the wear pad means under adjusted pressure to establish said watertight sealage.

* * * * *